US005099991A

United States Patent [19]

Kitagawa et al.

[11] Patent Number: 5,099,991

[45] Date of Patent: Mar. 31, 1992

[54] PACKAGE OF ELECTROLYTIC CAPACITORS, WITH A FOLDED TERMINAL PROTECTION PART

[75] Inventors: Toshiyuki Kitagawa; Hideharu Nagai; Tooru Yamaguchi; Fumiaki Kawaguchi, all of Uji, Japan

[73] Assignee: Matsushita Electric Industrial Co., Ltd., Kadoma, Japan

[21] Appl. No.: 592,467

[22] Filed: Oct. 3, 1990

[51] Int. Cl.[5] ..... B65D 73/02

[52] U.S. Cl. ..... 206/328; 206/522; 206/586

[58] Field of Search ..... 206/521, 522, 588, 592, 206/328, 586, 333

[56] References Cited

U.S. PATENT DOCUMENTS

| | | | |
|---|---|---|---|
| 1,057,587 | 4/1913 | Schmedtje | 206/521 |
| 1,965,227 | 7/1934 | Fiero | 150/52 |
| 2,692,077 | 10/1954 | Kuhlman | 229/14 |
| 3,265,945 | 8/1966 | Jennings et al. | 317/258 |
| 4,154,344 | 5/1979 | Yenni, Jr. et al. | 206/524.6 |
| 4,324,329 | 4/1982 | Tani | 206/328 |
| 4,852,737 | 8/1989 | Noll | 206/330 |

FOREIGN PATENT DOCUMENTS

| | | | |
|---|---|---|---|
| 0022309 | 1/1981 | European Pat. Off. . | |
| 2906850 | 8/1979 | Fed. Rep. of Germany | 206/522 |
| 2415943 | 9/1979 | France | 206/522 |
| 2213464A | 8/1989 | United Kingdom | 206/521 |

*Primary Examiner*—Paul T. Sewell
*Assistant Examiner*—Thomas P. Hilliard
*Attorney, Agent, or Firm*—Cushman, Darby & Cushman

[57] ABSTRACT

Electrolytic capacitors 14 having terminals 15, 16 on one base face and a fixing frame at the other end part are inserted in bags made of air-bubble plastic sheet of tubular shape whose one end is welded to form an end and further having a terminal-protection part 13 made by folding the end part of the bag and welded to the welded part 12, and the bags 11 containing the electrolytic capacitor 14 are compactly packed in a box 18 of corrugated cardboard in alternating direction and flaps 191, 191, 192, 192 are closed and sealed; the electrolytic capacitors 14 having delicate terminals 15, 16 are safely and compactly packed in the box 18, and the terminals 15, 16 and the bent part of the fixing frames 17, are safely isolated by the bag.

3 Claims, 7 Drawing Sheets

FIG. 6 (a) (Prior Art)
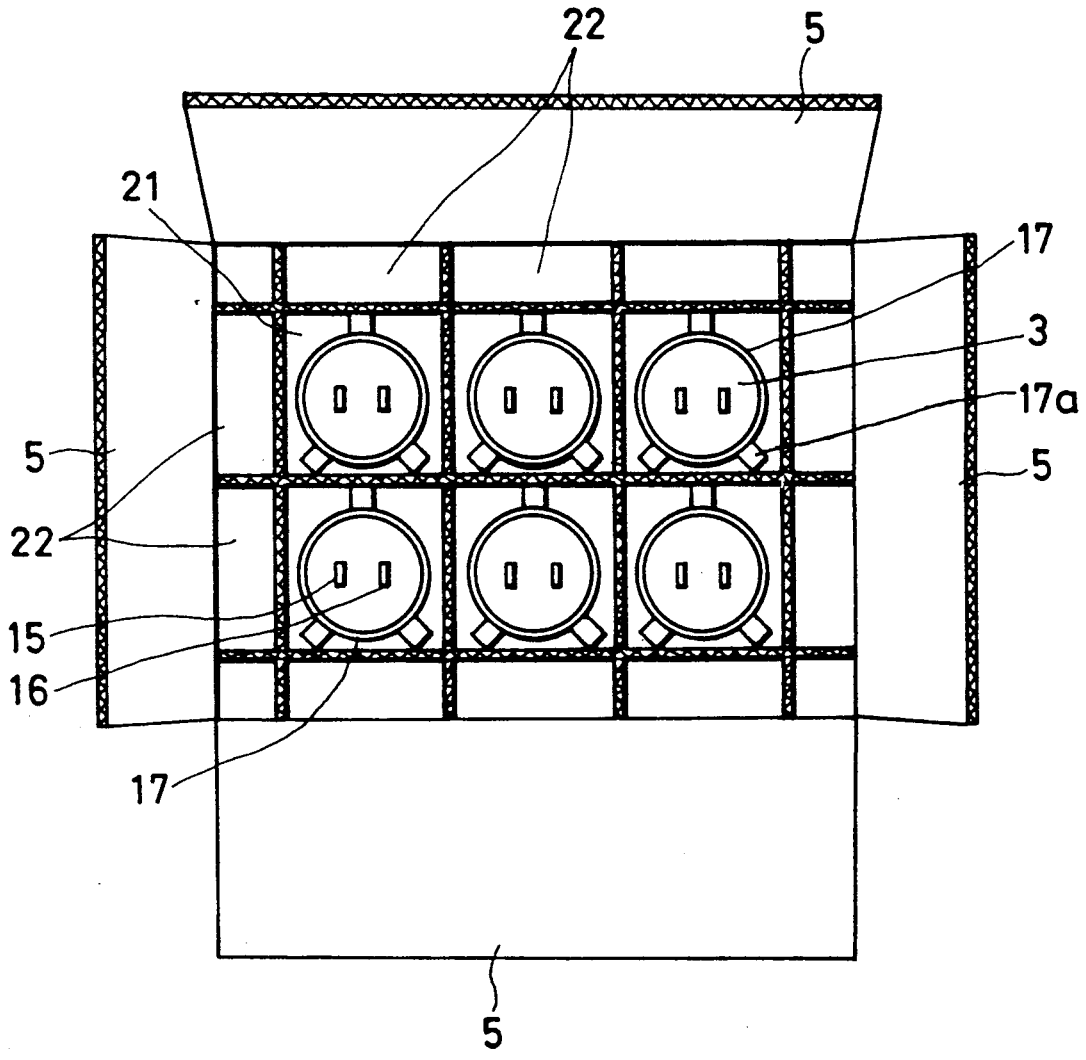

PACKAGE OF ELECTROLYTIC CAPACITORS, WITH A FOLDED TERMINAL PROTECTION PART

FIELD OF THE INVENTION AND RELATED ART STATEMENT

1. Field of the Invention

The present invention relates to an improvement in wrapping device for electrolytic capacitors, and particularly to the wrapping device wherein a plurality of electrolytic capacitors are contained safely and compactly for transportation, for instance, from manufacturing shop to assembly shop.

2. Description of the Related Art

FIG. 6, FIG. 6(*a*), FIG. 7 and FIG. 8 show a wrapping device for electrolytic capacitors of typical prior art. As shown in FIG. 6 through FIG. 8, the prior art device comprises a cardboard box 1 having flaps 5, partition member 2 configurated by several pieces of cardboard to be inserted in the box 1 and a cushion mat 4 to be inserted in the box 1 for protecting terminals of capacitor.

In the above-mentioned conventional wrapping device for electrolytic capacitors, a plurality of the electrolytic capacitors 3 are inserted in partitioned spaces 21 in the partition members 2 with its end having the terminals 15, 16 upwards toward the side of opening. And thereafter, the terminal-protection member 4, for instance of foamed plastic board, corrugated cardboard or a foamed polyethylene cushion mat is placed on the partition member 2 to protect the terminals 15, 16 of the electrolytic capacitors 3,. Thereafter, the flaps 5, are folded on the terminal-protection member 4 to close the box, and finally, the flaps are sealed by adhesive tapes 6 as shown in FIG. 7.

In the above-mentioned conventional wrapping device for electrolytic capacitors the partition member 2 which has to be assembled prior to packing the electrolytic capacitors 3, in the box 1 is necessary. Besides, isolation spaces 22 around the electrolytic capacitors 3 are required so as to insert respective electrolytic capacitors each having fixing frame 17 their one end part and around the outside of the partition member assembly and inside wall of the cardboard box 1. And further, putting the thick terminal-protection member 4 in the box 1 is required.

The above-mentioned wrapping device for electrolytic capacitors has the problem of not only space-taking but also time-taking in assembling the box 1 with the partition member 2 and necessitates careful packing the electrolytic capacitors in each partitioned space. And furthermore, the fixing frames 17 may scratch outside face of the adjacent electrolytic capacitors 3.

OBJECT AND SUMMARY OF THE INVENTION

The present invention purposes to provide an improved wrapping device for electrolytic capacitors in which no partition member to be preliminarily assembled and a thick terminal-protection member are required, and furthermore the device can pack the electrolytic capacitors more compact and more safely than in the prior art device.

The wrapping device for electrolytic capacitors in accordance with the present invention comprises:

a plurality of bags made of air-bubble plastic sheet, each bag being for containing one electrolytic capacitor, which is fundamentally of cylindrical shape and has terminals on one base face thereof, and shaped as a tube which has an opening at one end for inserting the electrolytic capacitor therethrough, a welded part at the other end closing the other end of the bag and a terminal-protection part which is disposed beyond the welded part for serving as a cushion member for the terminals of the electrolytic capacitor, and a cardboard box with lid flaps for fittingly containing the plurality of bags each with one electrolytic capacitor enclosed therein, and enclosing the plurality of bags and electrolytic capacitors by closing the lid flaps.

The air-bubble plastic sheet is a transparent cushion sheet which is widely used as packing material for fragile articles and made of a pair of soft thin transparent plastic sheets confining a number of air bubbles between the two thin plastic sheet.

By the above-mentioned configuration, the packing can be made with smaller working steps and smaller number and kinds of components, and therefore, work time and cost of the packing can be reduced. Furthermore, by using the bag 11 of air-bubble plastic sheet having recessed part inside the bag at the welded part, the terminals of the electrolytic capacitor is safely protected, and further the fixing frames are isolated from each other and from the terminals by alternate packing of the electrolytic capacitor in the corrugated cardboard box.

BRIEF DESCRIPTION OF THE DRAWINGS

FIG. 1(*b*) is a side view showing the bag containing the electrolytic capacitor.

FIG. 1(*c*) is a perspective view showing a cardboard box which contains the bags each containing the electrolytic capacitor therein and with its flaps open.

FIG. 6(*a*) is the plan view with flaps of box open of the conventional wrapping device.

It will be recognized that some or all of the Figures are schematic representations for purposes of illustration and do not necessarily depict the actual relative sizes or locations of the elements shown.

DESCRIPTION OF THE PREFERRED EMBODIMENTS

Figure 1A:
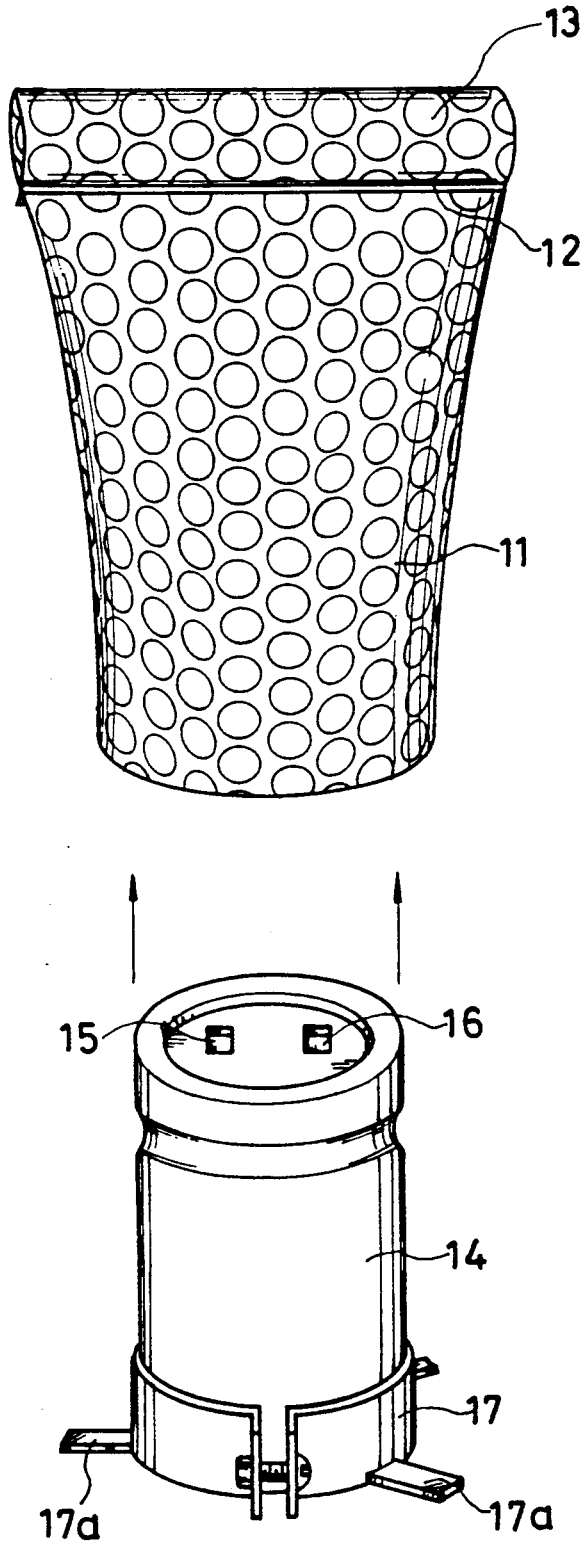
FIG. 1(*a*) is a perspective view showing a bag and an electrolytic capacitor to be inserted in the bag.
Figure 1:
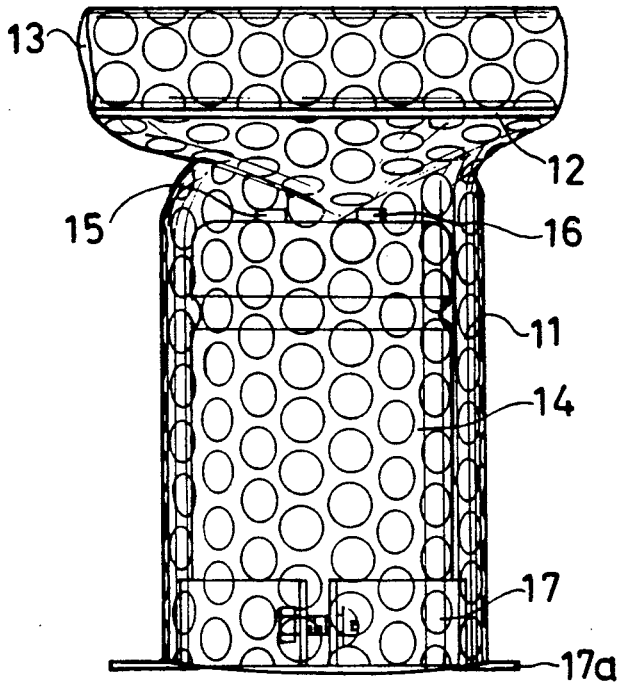
Figure 1:
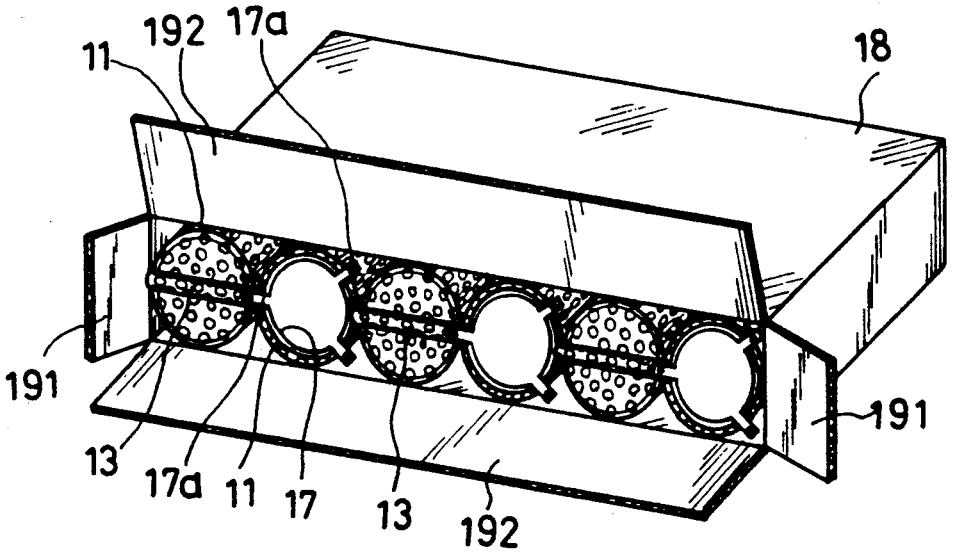
Figure 2:
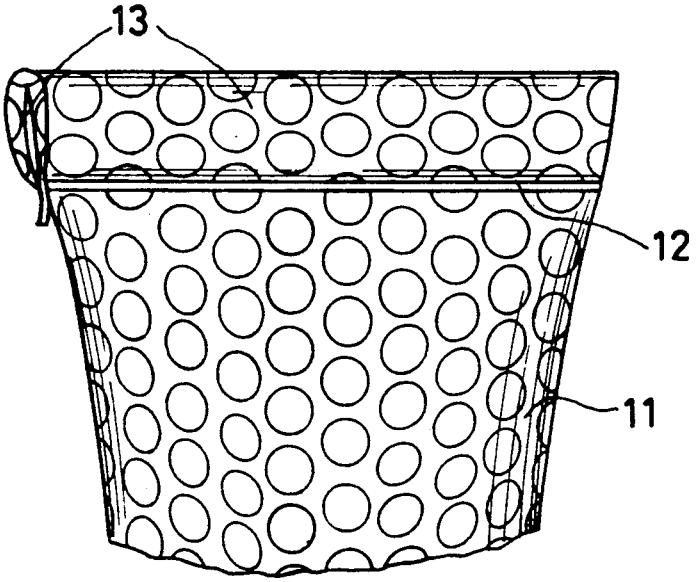
FIG. 2 is a perspective view showing a terminal-protection part and welded part of the bag.
Figure 3:
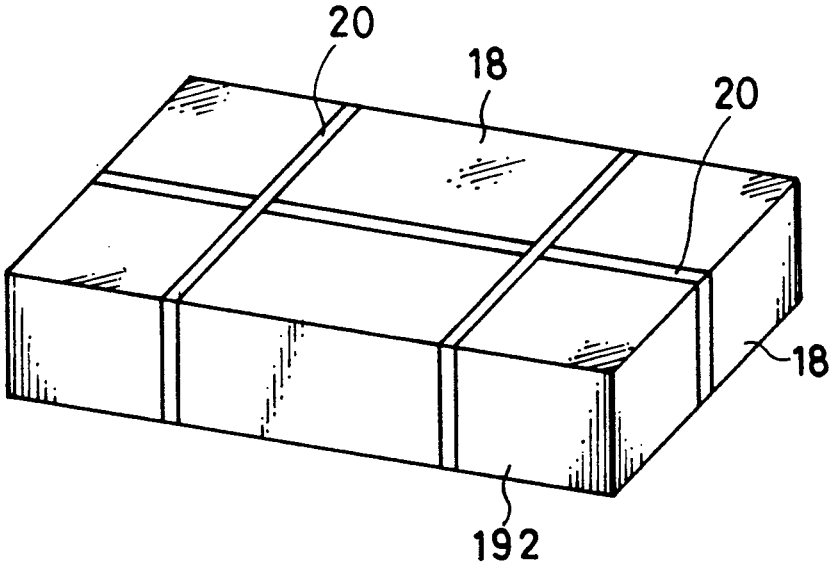
FIG. 3 is a perspective view showing finally packed state of the wrapping device for electrolytic capacitors in accordance with the present invention.
Figure 4:
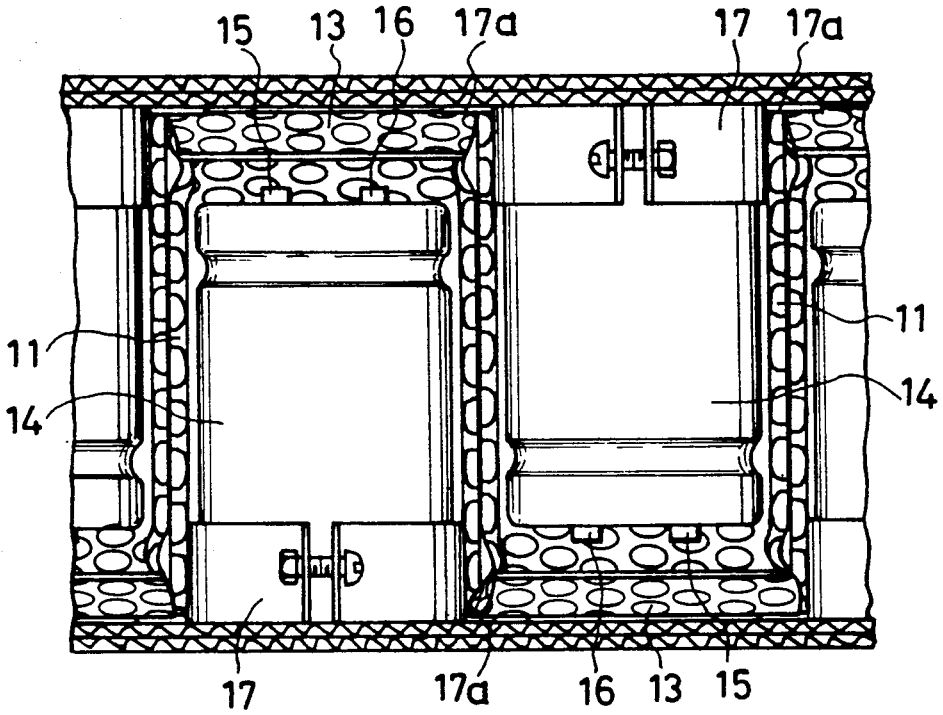
FIG. 4 is a sectional side view showing the inside of the box with the covering cardboard removed.

FIG. 1(*a*), FIG. 1(*b*), FIG. 1(*c*), FIG. 2, FIG. 3 and FIG. 4 shows a first preferred embodiment.

As shown in FIG. 1(*a*), FIG. 1(*b*) and FIG. 2, a bag 11 is made of a tubular shaped air-bubble plastic sheet having an inner diameter slightly larger than outer diameter of cylindrical part of an electrolytic capacitor 14 and length suitable for containing the cylindrical part of the electrolytic capacitor 14 therein. One end of the air-bubble plastic sheet tube forms an opening 111, and at the other end there is provided a welded part 12 and further a terminal-protection part 13 at the part beyond the welded part 12. The terminal-protection part 13 is formed by, for instance, folding the end part which is beyond the welded part and then welding the folded end part on the welded part 12.

As shown in FIG. 1(*a*), the electrolytic capacitor 14 is inserted in the bag 11 in a manner that the end face having anode terminal 15 and cathode terminal 16 is at innermost part and a fixing frame 17 outermost, so that bent members 17*a* or flange is outside the opening 111. Thus, the electrolytic capacitor 14 is to be inserted so that the terminal 15, 16 face the inside recess formed immediately inside the welded part 12.

Thereafter the bags 11 each containing the electrolytic capacitor 14 are compactly inserted in a box 18 of corrugated cardboard with flaps 191, 191, 192, 192. The directions of insertion of the bags 11 with the electrolytic capacitors 14 therein are in alternate order so that neighboring bags are directed with its terminal-protection part 13 alternatingly inward and outward. Therefore the fixing frames 17, are arranged always adjacent to the terminal-protection part 13.

Thereafter flaps 191, 191, 192, 192 are closed and the box is closed by known adhesive tapes 20 to seal the box 18.

As a result of the above-mentioned configuration, there is no use of the hitherto used partition members which require preliminary assembling, and there is no redundant spaces around the outside face of the partition members and in each partitioned spaces.

Figure 6:
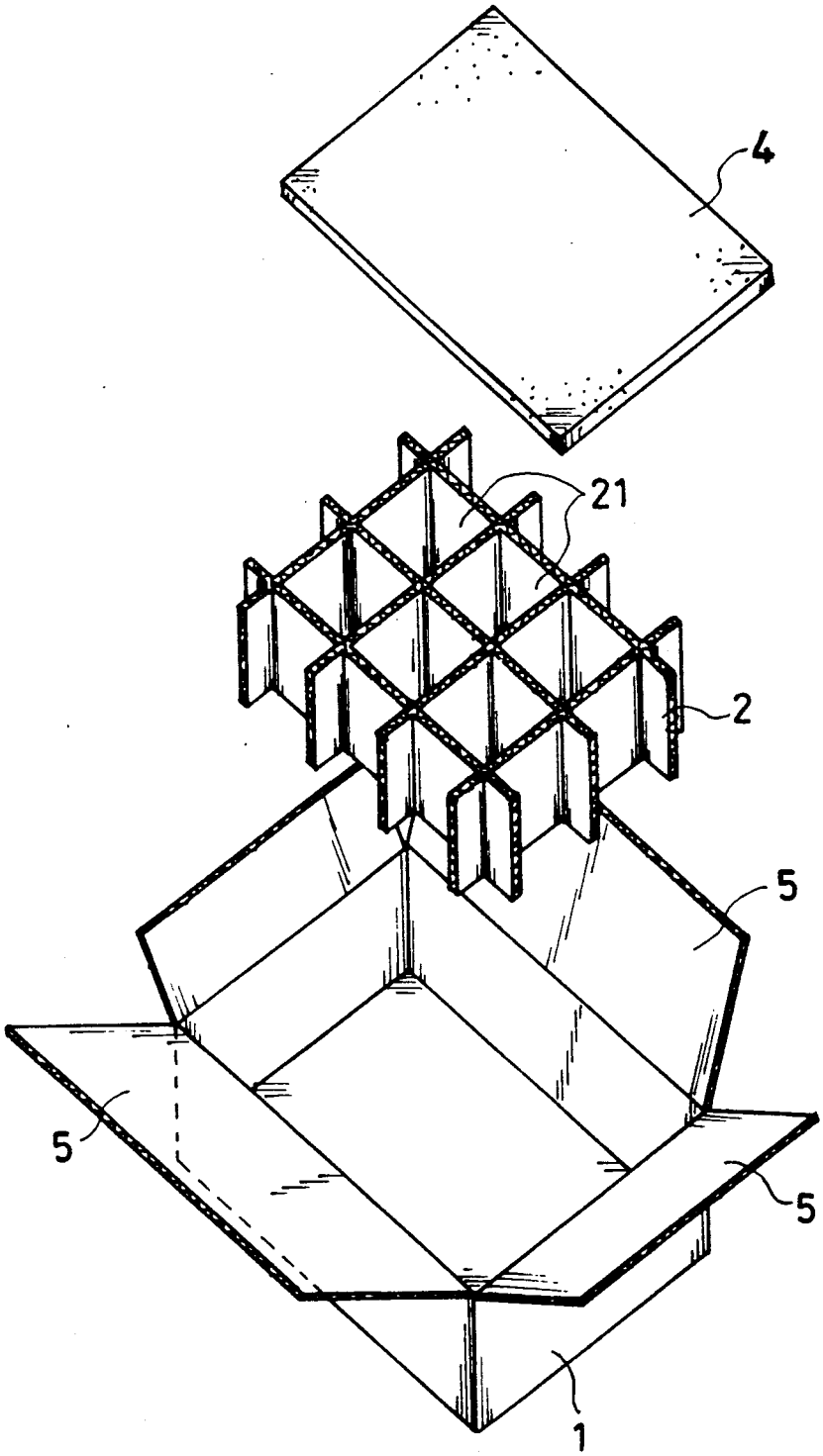
FIG. 6 (Prior Art)
FIG. 6 is a perspective view of the conventional wrapping device.
Figure 7:
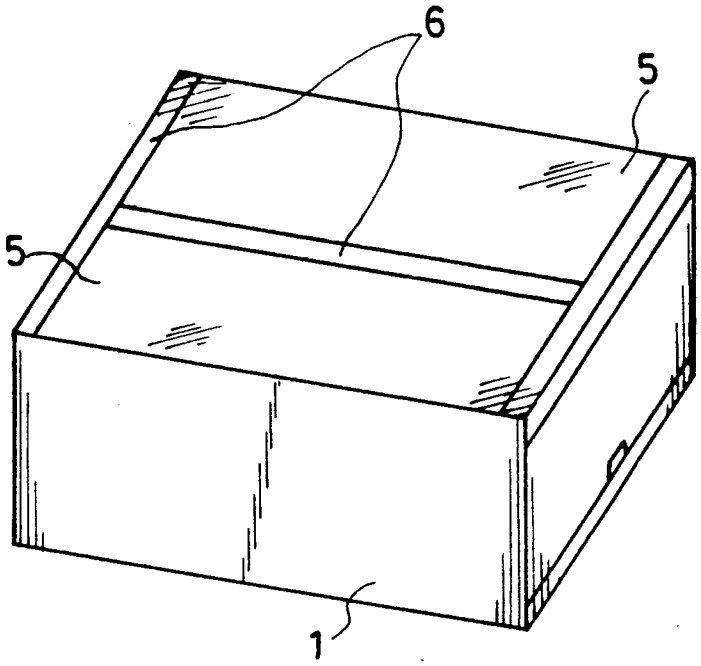
FIG.7 (Prior Art)
FIG. 7 is the perspective view showing finally sealed wrapping device of the prior art.
Figure 8:
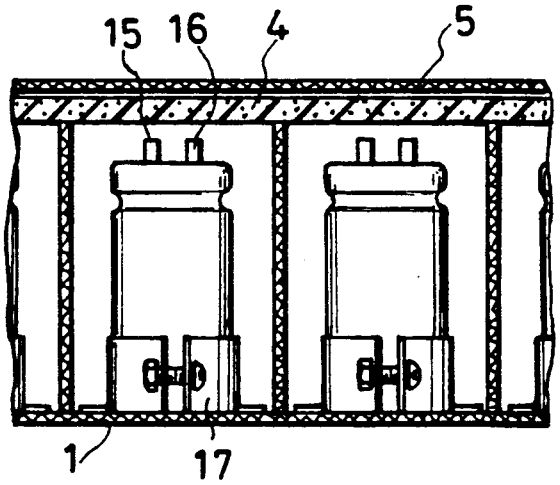
FIG.8 (Prior Art)
FIG. 8 is the sectional side view showing inside arrangement of the electrolytic capacitors in the conventional wrapping device.

Furthermore, fragile anode terminals 15 and cathode terminals 16 are covered in recessed space inside the welded part 12 of the bag 11, and therefore there is no use of using the hitherto-used thick terminal-protection member (4 of FIG. 6), and therefore the space therefor is omitted.

Furthermore by arranging the fixing frames 17, alternately inside and outside of the corrugated cardboard box 18, the fixing frames 17 touches and is held by the thick and soft terminal-protection part 13 only, and therefore the fixing frames 17, and the outside of the adjacent cans 14 are not damaged by each other. As has been mentioned, by compact packing of the bags 11 each containing the electrolytic capacitor 14 in alternating directions, safe and compact packing of plural electrolytic capacitors is obtainable.

Figure 5:
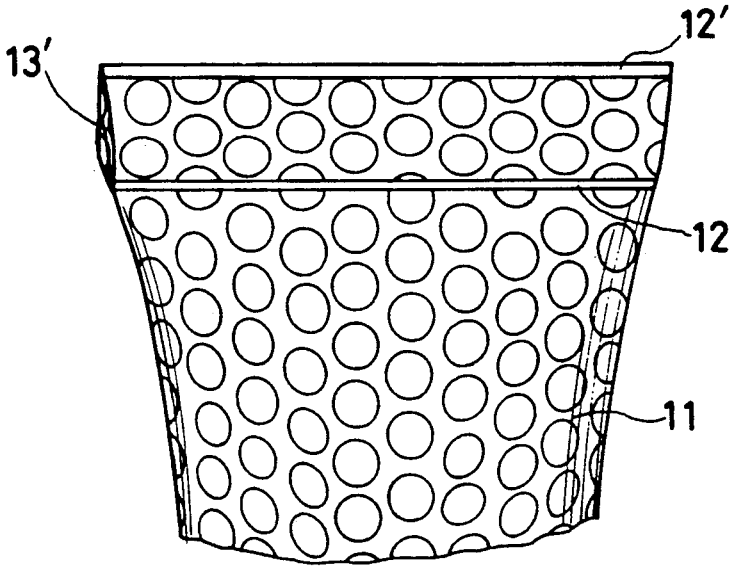
FIG. 5 is a perspective view showing a terminal-protection part of another embodiment of the bag.

FIG. 5 shows another example of the bag 11 wherein the terminal-protection part 13 is formed by providing two parallel welded parts 12 and 12' with a suitable distance therebetween, instead of folding the end part. This configuration of the terminal-protection part 13' also has a good cushion effect and sufficiently protect the anode terminal 15 and cathode terminal 16, and is suitable for mass-production.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is

1. Package of electrolytic capacitors having terminals on one base face, comprising:

a plurality of bags made of air-bubble plastic sheet, each bag being shaped as a tube having an opening at one end for inserting said electrolytic capacitor therethrough, a transverse weld at the other end closing the other end of said bag and a terminal-protection part which is disposed beyond said weld and formed by folding the other end of said air-bubble plastic sheet and traversely welding the folded end to define a cushion member for protecting the terminals of said electrolytic capacitor, and a cardboard box with lid flaps for fittingly containing said plurality of bags each with one electrolytic capacitor disposed therein so that said terminals of said electrolytic capacitors are adjacent the closed end of the bag, and enclosing said plurality of bags with said electrolytic capacitors by closing said lid flaps.

2. Package of electrolytic capacitors having terminals on one base face and a fixing frame on the other face, comprising:

a plurality of bags made of air-bubble plastic sheet, each bag being shaped as a tube having an opening at one end for inserting said electrolytic capacitor thereinto, a transverse weld at the other end closing the other end of said bag and a terminal-protection part which is disposed beyond said weld and formed by folding the other end of said air-bubble plastic sheet and transversely welding the folded end to define a cushion member for protecting the terminals of said electrolytic capacitor, and a cardboard box with lid flaps for fittingly containing said plurality of bags each with one electrolytic capacitor disposed therein so that said terminals of said electrolytic capacitor are adjacent the closed end and said fixing frame is adjacent the open end of the bag and said terminal-projection parts of adjacent bags are arranged alternately thereby arranging said fixing frame of adjacent electrolytic capacitors alternately, and enclosing said plurality of bags with said electrolytic capacitors by closing said lid flaps.

3. Package of electrolytic capacitors in accordance with claim 1 or claim 2, wherein said terminal protection part is formed by forming a second weld which is substantially parallel to, beyond and spaced from said bag closing weld.

* * * * *